United States Patent [19]

Alguire et al.

[11] 4,378,334

[45] Mar. 29, 1983

[54] APPARATUS FOR DISPOSAL OF SPENT STERILANT OR BIOCIDAL GASES

[75] Inventors: Donald E. Alguire; Anthony C. Yeung, both of Downers Grove, Ill.; Fernand Cammaerts; Albert Aerts, both of Herentals, Belgium

[73] Assignee: Griffith Laboratories U.S.A., Inc., Alsip, Ill.

[21] Appl. No.: 167,666

[22] Filed: Jul. 11, 1980

[51] Int. Cl.[3] ..... B01J 4/00; B01D 53/34

[52] U.S. Cl. ..... 422/110; 422/111; 422/112; 422/115; 422/182; 110/189; 110/345; 423/210; 423/245; 431/5

[58] Field of Search ..... 423/210, 245; 110/189, 110/345, 205, 206, 214; 422/109, 110, 111, 112, 114, 182, 183, 115; 431/5

[56] References Cited

U.S. PATENT DOCUMENTS

| | | | |
|---|---|---|---|
| 3,838,974 | 10/1974 | Hemsath et al. | 422/111 |
| 3,914,088 | 10/1975 | Huyck | 422/107 X |
| 4,087,923 | 5/1978 | Wih, Jr. et al. | 431/5 X |
| 4,101,632 | 7/1978 | Lamberti et al. | 431/5 X |
| 4,144,014 | 3/1979 | Hartwig | 431/5 |
| 4,238,460 | 12/1980 | Aiken et al. | 422/112 X |

*Primary Examiner*—Earl C. Thomas

*Attorney, Agent, or Firm*—Michael G. Berkman

[57] ABSTRACT

A method and control apparatus for the safe and effective ultimate disposal of spent biocidal gases such as alkylene oxides after their use in a reactor, including hopsital-type gaseous sterilizers, to reduce the concentration of viable organisms present as contaminants in articles treated in the reactor. The disposal is carried out in a manner to prevent air contaminating release of objectionable material into the atmosphere. The process includes the steps of pumping the biocidal gas from the reactor, delivering the gas to a combustion chamber fitted with a flue gas stack, and igniting and burning the gas in the combustion chamber in the presence of and aided by an added auxiliary combustible fuel augmented by a supply of air. Safety devices such as temperature controls and sensors, flame sensors, flash arrestors, and automatic shut off valves minimize potential hazards.

10 Claims, 1 Drawing Figure

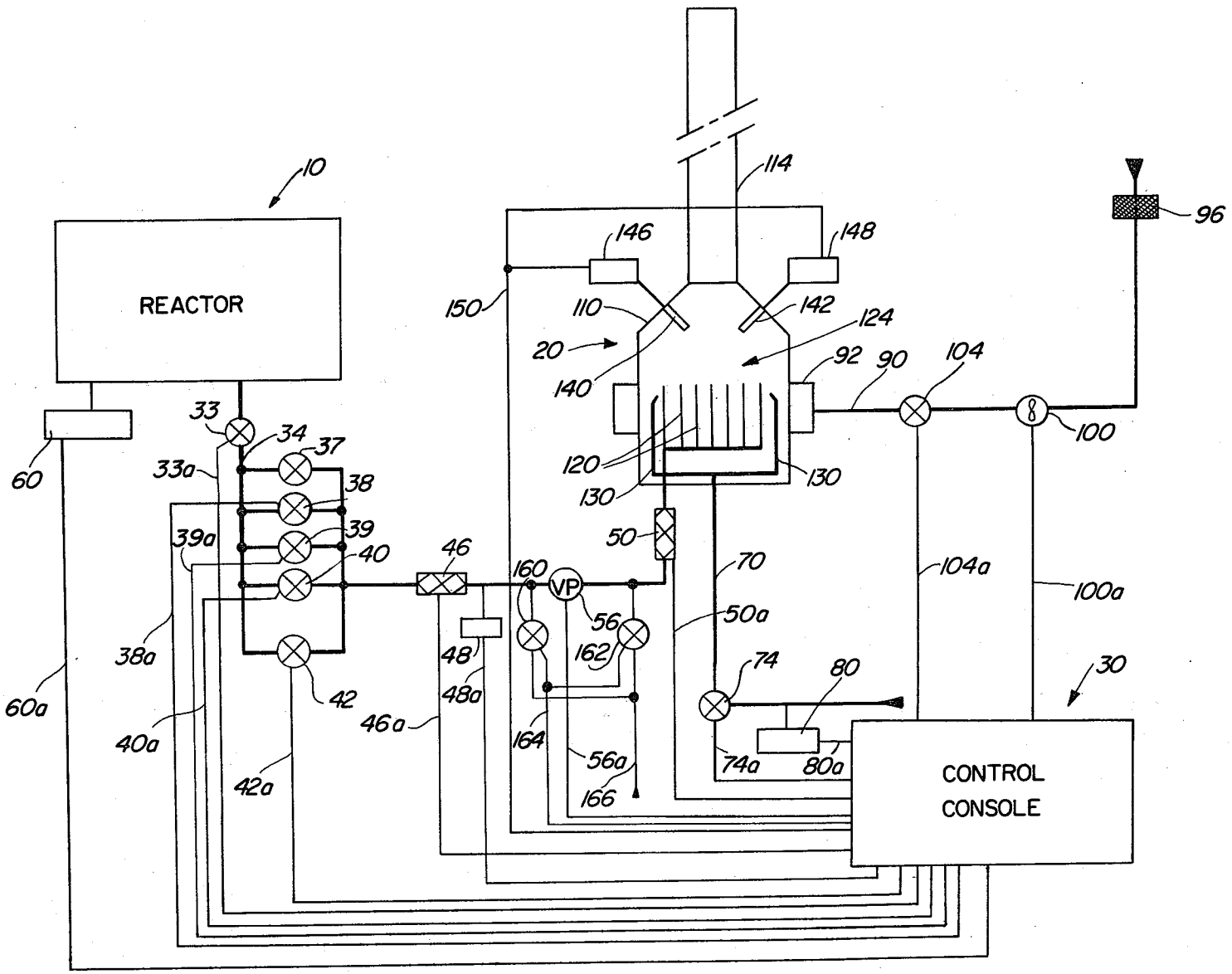
CONTROL CONSOLE
REACTOR
VP

APPARATUS FOR DISPOSAL OF SPENT STERILANT OR BIOCIDAL GASES

BACKGROUND OF THE INVENTION

The present invention relates generally to gaseous sterilization and biocidal reduction processes of the type in which volatile gases such as alkylene oxides, are used as biocidal agents to reduce the concentration of viable organisms present as contaminants on and in articles in which such presence is objectionable. Gaseous sterilization and biocidal reduction with gaseous agents including ethylene oxide and propylene oxide are widely accepted techniques specially adapted to the treatment of perishable and fragile substances such as agricultural products, foodstuffs, pharmaceutical agents and medical and surgical instruments and apparatus, including ingredients instruments, devices and apparatus treated in hospital-type gaseous sterilizers.

Alkylene oxides such as ethylene oxide or propylene oxide gases have been employed extensively in the sterilization and biocidal reduction of many types of materials because of the non-corrosive nature of the gases and because the gases are nondestructive with respect to most materials including plastics, adhesives, commestibles, drugs, and delicate equipment including delicate metallic devices. An additional attractive feature of these gases is that they are highly effective biocidal materials at ambient temperatures and that they act rapidly.

However, the use of gases such as alkylene oxides as biocidal or sterilizing agents is subject to several objections, for example, a high degree of flammability. Additionally, mixtures of the lower alkylene oxides such as ethylene oxide and propylene oxide with air, in certain proportions, are explosive. In order to reduce or substantially to eliminate the hazards indicated, it has been a common practice to dilute alkylene oxides with inert gases such as halogenated hydrocarbons or with carbon dioxide. A commercially available mixture consists of about 12% by weight of ethylene oxide mixed with about 88% by weight of a halogenated hydrocarbon such as dichloro difluoro methane (Freon 12) to obviate flammability and to prevent formation of an explosive atmosphere.

The conventional manner in which the biocidal gas system is used is to place articles or materials in a reactor tank or chamber and then to introduce a predetermined composition of biocidal gas at controlled conditions of temperature and pressure. Upon the elapse of a predetermined treatment period, the biocidal gas is pumped from the reactor and either discarded into the atmosphere; or diluted with water and discarded into the sewers or a dry well; or reclaimed for reconstitution and reuse. The discharge or release of the spent biocidal gas into the atmosphere, sewers or a dry well poses ecological problems. This is also true for biocidal gaseous systems which include the halogenated hydrocarbons as diluents. Moreover, the presence of such diluents has been found to have a deterent effect upon the activity of the biocidal gas itself, so that longer treatment periods have been required in order to ensure effective reduction in the concentration of viable organisms.

The aim of the present invention is to obviate the shortcomings of prior art compositions and techniques and to provide a process and apparatus whereby the spent biocidal gases may be effectively and safely disposed of without hazard and without contaminating the ambient atmosphere with these gases.

SUMMARY OF THE INVENTION

The present invention provides a technique which enables one to dispose of the used biocidal gas, without inert diluent, so as to maintain the maximum biocidal effect of such sterilant gases.

In accordance with the practice of the present invention, the practicality of using an undiluted biocidal gas such as alkylene oxide is achieved by providing an effective and safe method and apparatus whereby the spent biocidal gas may then be safely and effectively disposed of without any hazard of explosion and without contamination of the ambient atmosphere with the biocidal gas.

An important object of the invention is to provide apparatus and a technique whereby spent biocidal gases such as ethylene oxide or propylene oxide may be safely and completely burned under carefully controlled conditions so as to preclude the hazard of explosion and to obviate atmosphere contamination.

A functional feature of the invention is the provision of a combustion chamber in which the biocidal gas removed from the reactor, after use, is effectively burned.

A related feature of the invention is the use of a flare stack which surmounts the combustion chamber further to ensure complete combustion of the spent biocidal gas.

Yet another feature of the invention is the use of an auxiliary combustion gas as an aid to the effective and complete burning of the biocidal gas delivered to the combustion chamber.

It is a feature of the invention that there is provided an auxiliary air input to the combustion chamber further to ensure the complete and effective combustion of the biocidal gas.

An important object of the present invention is to provide a combustion system for the dissipation of biocidal gases, in which system any biocidal gases discharged into the ambient system are below concentrations permissible under anti-pollution legislation, and less than 0.1 kg/hr and 20 mg/m$^3$ for ethylene oxide.

Yet another feature of the invention is the use of an evacuation pump in conjunction with a plurality of parallelly connected valves for controlling the rate of gas exhaust from the reactor or biocidal treatment chamber.

A related feature of the invention is the use of a positive pump for introducing auxiliary air into the combustion chamber to enhance the burning of the biocidal gas.

Still other features of the combustion system of the invention include flame sensors in the combustion chamber and flash arrestors in the gas input lead lines.

General features of the invention include automatic controls which are keyed to the various sensing mechanisms and responsive to such mechanisms to shut off gas input to the combustion chamber in the event that the flame should become extinguished or if the internal temperature of the combustion chamber should exceed a predetermined critical value.

A practical feature of the invention is that the entire combustion system may be incorporated in new installations or may, alternatively, be connected into existing gas sterilization or biocidal reduction systems, as a retrofit.

Other and further objects, advantages, and features of the invention will become apparent from a consideration of the specification in conjunction with the drawing.

BRIEF DESCRIPTION OF THE DRAWING

The drawing is a schematic illustration of the flare burner gas combustion system, in accordance with the invention, depicting the operative components and controls. The graphic representation is not intended to be either limiting or all-inclusive, but serves to facilitate a description of those elements which constitute components of the novel process and apparatus of the present invention.

DESCRIPTION OF THE PREFERRED EMBODIMENT

The objects and advantages of the invention are achieved by providing, for use with a gas sterilization or biocidal reduction system of the type utilizing a flammable sterilant gas, a combustion chamber fitted with a flue gas stack and sensing and control means for ensuring the proper rate of evacuation of biocidal gas from the reactor vessel. Auxiliary gas and air supply means are provided for controlling and for ensuring the complete combustion of the biocidal gas, even in the presence of substantial concentrations of water vapor contained in the biocidal gas.

The schematic drawing illustrates a preferred embodiment of the invention in which the combustion system is connected to a reactor or biocidal reduction chamber which may be of conventional form including an access door, means for introducing sterilant or biocidal gas into and for removal of the sterilant or biocidal gas from the reactor, water vapor input lines, pressure gauges, heaters, thermometers and other control and sensing mechanisms. Such biocidal reduction systems or sterilizers are well known to those skilled in the relevant art and, accordingly, no detailed description is included herein. In the conventional, well-known procedure for utilizing a gaseous biocidal reduction material such as ethylene oxide, the articles to be treated are placed within the chamber and sterilization or biocidal reduction is effected by introducing the gaseous biocidal agent into the reactor through appropriate pipes and control valves. The process may be enhanced through the use of a heat exchanger and controls, all as known in the art.

It has been the practice, heretofore, to discharge the biocidal gas to atmosphere or into the sewers after the gas has fulfilled its intended role. It is to the avoidance of this indiscriminate contaminating release of biocidal gas into the ambient system that the present invention is directed.

Referring now to the drawing, there is shown, for illustrative purposes and not in any limiting sense, a sterilization or biocidal reduction chamber or reactor 10, a combustion chamber or vessel 20, and a control console 30. A sterilant gas exhaust line 34 is connected to 10 and 20 for delivering gas from the sterilizer 10 to the combustion chamber 20 through a series of parallelly arranged control valves 33, 37, 38, 39, 40, and 42. Interposed in series in the reactor discharge line 34 are flame arrestors 46 and 50 for preventing flashback of ignited gas from the combustion chamber 20. A pump 56 serves to exhaust the biocidal gas from the reactor 10 through the exhaust line 34 and its associated valves, flame arrestors, and related elements. As indicated, the reactor 10 is provided with a sensor 60 responsive to the pressure of the sterilant gas contained in the reactor 10. The pressure sensors 48, 60, the control valves 33, 37, 38, 39, 40, and 42, the flame arrestors 46 and 50, and the vacuum pump 56 are each connected by respective leads **48*a*, 60*a*, 33*a*, 38*a*, 39*a*, 40*a*, 42*a*, 46*a*, 50*a*, and 56*a* to the console 30**.

Auxiliary combustible gas, from a conventional supply (not shown) is fed into the combustion chamber 20 through a gas conduit 70. The rate of auxiliary gas introduction is controlled by means of an inline valve 74 and a pressure sensor 80, each being connected by corresponding lead lines **74*a* and 80*a* to the control console 30**.

In the preferred embodiment of the combustion system illustrated, auxiliary combustion-supporting air is introduced into the combustion chamber 20 through an air supply line 90 connected into the combustion chamber 20 through a chamber-encircling air ring or channel 92. The air line 90 is fitted with a filter 96, a fan 100, and a control valve 104. The fan 100 and the valve 104 are connected by corresponding lead lines **100*a* and 104*a* to the control console 30**.

At its upper portion, the flare burner combustion chamber 20 is surmounted by a frusto-conical section 110 from which there projects an elongated pipe or flue 114.

Referring now briefly to the interior of the combustion chamber 20, the biocidal gas input from the reactor 10 is distributed through a manifold-like series of pipes 120 which constitute part of the biocidal gas burner 124 of the combustion system. The auxiliary gas is delivered into the combustion chamber 20 by means of a series of pipes 130 connected to the gas lead line 70.

The combustion chamber 20 is provided with a pair of flame detectors 140 and 142 connected to corresponding sensors 146 and 148, the latter being, in turn, connected by means of a lead line 150 to the control console 30.

The operation of the sterilant or biocidal reduction gas combustion system will be readily understood with reference to the previous description considered in conjunction with the following additional explanatory material. In the preferred embodiment of the assembly illustrated, the burner 124 is designed for the effective combustion of essentially 100% ethylene oxide. In the contemplated use, the biocidal gas is supplied to the burner 124 at spaced time intervals of from about 4 to 16 hours by evacuation of the retort or reactor 10. Relevant parameters in the design criteria for the system shown provide for a maximum gas flow rate of about 50 cubic meters per hour at a gas temperature of 20° centigrade, a pressure of 1043 mbar for a gas having a molecular weight of about 44.1; that is, ethylene oxide.

Biocidal gas, evacuated from the reactor 10 by means of the vacuum pump 56, passes through the flame arrestors 46 and 50 and is delivered to the burner 124. The sterilent or biocidal reduction gas supply system is pressure-dependent. That is, upon starting of the vacuum pump, only the control valve 33 is opened and gas is evacuated through control valve 37 which is manually preset. When pressure sensor 48 senses the reaching of 80 mbar it operates through lead line **48*a* and control console 30 to open the gas flow control valve 38. Immediately after opening of gas flow control valve 38 pressure at the input of the vacuum pump will rise aboue 80 mbar and the output signal of sensor 48** is reset.

After a certain time, the pressure at the input of the vacuum pump again will reach 80 mbar and pressure sensor 48 will operate through lead line 48*a* and control console 30 to open the gas flow control valve 39. Immediately after opening of gas flow control valve 39, both 38 and 39 are open now, the pressure at the input of the vacuum pump will rise above 80 mbar and the output signal of sensor 48 is reset.

In a similar manner as described above, gas flow control valves 40 and 42 will be opened subsequently.

The substantive effect of the structure and controls describe is that the vacuum pump 56 supplies relatively constant mass flow of biocidal gas to the combustion chamber.

Combustion air input to the combustion chamber 20 is regulated by a fan 100 and valve 104 to deliver air through a ring channel 92 at the flame front of the burner 124. Auxiliary combustible gas input to the combustion chamber 20 is controlled and maintained by a pressure control 80, a valve 74 and pilot burners 130.

An important feature of the invention is the regulating circuit which controls the dosage of the combustion air. At full biocidal gas pressure in the retort or reactor 10, as measured by pressure sensor 60 the regulating valve 104 in the air supply line 90 is fully open. With increased vacuum (drop in the pressure within the reactor 10) the regulating valve 104 tends to close until, upon reaching a pressure of about 20 mbar, the air valve 104 locks at about 15% open.

The sterilant or biocidal reduction gas combustion system is provided with automatic safety and control mechanisms pertaining both to the ignition system and to the evacuation of the reactor 10.

After predetermined biocidal treatment time is over, the control console 30 sends a signal along lead line 164 to open valves 160 and 162. Nitrogen from nitrogen supply line 166 is supplied to the conduits at input and output side of the vacuum pump during a preset time of about 100 seconds.

The substantial effect of this operation is to purge the biocidal gas carrying conduits with nitrogen to ensure that only a non-explosive mixture is present in these conduits at the start of the combustion system.

After the nitrogen purge time is over, the ignition system is started automatically. Successful ignition of pilot gas will be detected by the two flame sensors 140 and 142. Sensing of the flame at the sensors 140 and 142 terminates the ignition cycle and closes a contact in control console 30 enabling the starting of the vacuum pump 56, air fan 100 and opening of control valve 33, appropriate signals being received through respective electrical lead lines 56*a*, 100*a* and 33*a*. Other inert gases, e.g. $CO_2$ may be used.

When the vacuum pump 56 and air fan 100 are operational, the biocidal gas is evacuated from the reactor 10 and supplied to combustion chamber 20. Upon reaching 80 mbar at the input of the vacuum pump the secondary valves 38, 39, 40 and 42 are opened subsequently in the manner previously described. Upon reaching 20 mbar in the reactor vessel 10, sensed by pressure sensor 60, the control console 30 sends signals through the appropriate lead lines 33*a*, 38*a*, 39*a*, 40*a*, 42*a*, 56*a*, 74*a*, 100*a* to close all valves in the vacuum line, to stop the vacuum pump, to close the valve in the auxiliary gas line and to shut off the fan 100.

Several additional safety features are provided in the apparatus described. For example, the burner assembly 124 includes a pilot gas pressure control 80 so that if the pilot gas pressure falls below a predetermined value, an alarm horn sounds. Additionally, if the pressure drops below 35 mbar, the pressure control 80 feeds a signal to the control console 30 whereupon a responsive signal is fed along the line 74*a* to close the gas valve 74. An emergency shutdown procedure is simultaneously activated under which the control console 30 sends signals along the lines 33*a*, 38*a*, 39*a*, 40*a* and 42*a* to close the valves 33, 38, 39, 40 and 42 in the vacuum line. Additional signals along the lines 56*a* and 100*a* turn off the vacuum pump 56 and the fan 100.

The flame arrestors 46 and 50 are each provided with temperature sensors. If the measured temperature at the flame arrestors rises aabove a predetermined maximum level, signals are fed to the control console 30 along lines 46*a* and 56*a* to activate a temperature alarm. Concurrently, the emergency shutdown system is activated, completely shutting off the combustion furnace and the control valves 33, 38, 39, 40 and 42 regulating the gas input to the combustion furnace 20.

As directed, the apparatus involved in the combustion system utilizes control instrumentation, audible and visual alarms, and all necessary switches and controls. Such control instrumentation and its proper use are well known in the relevant art. Accordingly, no exhaustive treatment is provided herein. All circuitry wiring and control elements are designed with due regard to safety and simplicity requirements. Again, since the controls and related circuitry are well-known to those in the art, no detailed description is included herein, or necessary.

While the present invention has been described with reference to a specific arrangement of pumps, valves, sensors, an air supply system and an auxiliary gas supply system, and while a particular form of the combustion vessel of the invention has been shown and described, it is to be understood that the disclosure is directed to a preferred embodiment. Various changes and modifications will occur to those skilled in the art, and such changes and modifications will occur to those skilled in the art, and such changes and modifications may be resorted to without departing from the concept of the invention or from the ambit of the following claims. All such modifications and variations are deemed to fall within the scope of the subject invention.

What is claimed is:

1. A biocidal gas disposal system for the withdrawal of biocidal gas from a reactor vessel after treatment of articles held temporarily in the reactor vessel to reduce concentrations of viable organisms present in said articles as contaminants thereof, said system including pump means connected to the reactor vessel, said pump means having gas input port means and gas exhaust port means for withdrawal and discharge or biocidal gas from the reactor vessel, combustion chamber means for receiving biocidal gas withdrawn from the reactor vessel, burner means within said combustion chamber means for combustion of biocidal gas delivered thereto, sensor means for sensing the presence and absence of a flame within said combustion chamber means, and means responsive to sensing of absence of a flame within said combustion chamber means to effect closure of said valve means thereby to prevent further input to and build-up of biocidal gas concentrations in said combustion chamber means, gas conduit means connecting the reactor vessel to said burner means in said combustion chamber means, flame arrestor means interposed in said gas conduit means between the reactor vessel and said combustion chamber means to prevent flash-back from said combustion chamber means, valve means connected into said gas conduit means for regulating and controlling the rate of withdrawal of biocidal gas from the reactor vessel and delivery to said burner means, pressure sensor means for sensing gas pressure within the reactor vessel, and valve control means operatively coupled to said pressure sensor means and to said valve means to regulate operational modes of said valve means as a function of biocidal gas pressure sensed in a reactor vessel, air input means for delivery of combustion-supporting air into said combustion chamber means, means including pipe means and valve means for introducing a combustible auxiliary gas into said combustion chamber means for burning together with said biocidal gas to promote and to enhance the combustion thereof, and flue gas stack means in gas flow communication with and surmounting said combustion chamber means, said flue gas stack means including a discharge opening for venting of combustion products to ambient atmosphere.

2. The structure as set forth in claim 1 wherein said burner means includes a ganged array of pipes connected in parallel to said gas conduit means and opening into said combustion chamber means as manifold means for distribution and dispersal of biocidal gas for combustion within said combustion chamber means.

3. The structure as set forth in claim 1 wherein said valve means include at least two separate valves connected in parallel and wherein said pressure sensing means functions to open, sequentially, a first of said valves at a given, predetermined gas pressure and then to open a second of said valves.

4. The structure as set forth in claim 1 wherein said air input means includes air fan means, air conduit means, and air input control valve means for regulating, as a function of pressure of biocidal gas in the reactor vessel, the amount of air delivered to said combustion chamber means.

5. The structure as set forth in claim 1 and further comprising temperature sensor means operatively connected to said flame arrestor means and responsive to sensed temperatures in excess of a predetermined value to close said valve means controlling withdrawal of biocidal gas from the reactor vessel and to shut down said gas recovery and disposal system, as a safety measure.

6. The structure as set forth in claim 3 wherein said pump means functions, in conjunction with said valve means and said pressure sensor means to maintain a substantially constant mass flow at said pump means.

7. The structure as set forth in claim 1 and further comprising a gas exhaust line for delivering gas including biocidal gas from the reactor vessel to said combustion chamber means, and further comprising exhaust line purging means for removing combustible biocidal gas from said gas exhaust line to obviate presence of an explosive mixture of gases in said exhaust line at initiation of combustion of biocidal gas in said combustion chamber means, thereby to preclude explosions in said gas exhaust line.

8. The structure as set forth in claim 7 wherein said purging means includes an inert gas as a gas exhaust line purging medium and means for delivery of said inert gas into said gas exhaust line.

9. The structure as set forth in claim 8 wherein said inert gas is nitrogen gas.

10. A biocidal gas disposal system for the withdrawal of biocidal gas from a reactor vessel after treatment of articles held temporarily in the reactor vessel to reduce concentrations of viable organisms present in said articles as contaminants thereof, said system including pump means connected to the reactor vessel, said pump means having gas input port means and gas exhaust port means for withdrawal and discharge of biocidal gas from the reactor vessel, combustion chamber means for receiving biocidal gas withdrawn from the reactor vessel, burner means within said combustion chamber means for combustion of biocidal gas delivered thereto, sensor means for sensing the presence and absence of a flame within said combustion changer means, and means responsive to sensing of absence of a flame within said combustion chamber means to effect closure of said valve means thereby to prevent further input to and build up of biocidal gas concentrations in said combustion chamber means, gas conduit means connecting the reactor vessel to said burner means in said combustion chamber means, flame arrestor means interposed in said conduit means between the reactor vessel and said combustion chamber means to prevent flash-back from said combustion chamber means, valve means connected into said gas conduit means for regulating and controlling the rate of withdrawal of biocidal gas from the reactor vessel and delivery to said burner means, pressure sensor means for sensing gas pressure within the reactor vessel, and valve control means operatively coupled to said pressure sensor means and to said valve means to regulate operational modes of said valve means as a function of biocidal gas pressure sensed in a reactor vessel, air input means for delivery of combustion-supporting air into said combustion chamber means, said air input means including a ring channel encircling said combustion chamber means and having air discharge ports annularly disposed therewithin, means including pipe means and valve means for introducing a combustible auxiliary gas into said combustion chamber means for burning together with said biocidal gas to promote and to enhance the combustion thereof, control means responsive to a drop in pressure of the axuiliary gas below a predetermined lower limit to cut off said burner means, to switch off said pump means and said air fan means, and to shut down said gas recovery and disposal system, and flue gas stack means in gas flow communication with and surmounting said combustion chamber means, said flue gas stack means including a discharge opening for venting of combustion products to ambient atmosphere.

* * * * *